US011225844B2

(12) United States Patent
Saruhashi et al.

(10) Patent No.: US 11,225,844 B2
(45) Date of Patent: Jan. 18, 2022

(54) SUBMARINE DRILLING SUPPORT SYSTEM

(71) Applicants: Japan Agency for Marine-Earth Science and Technology, Kanagawa (JP); Nustar Technologies Pte, Ltd, Singapore (SG)

(72) Inventors: Tomokazu Saruhashi, Yokosuka (JP); Ikuo Sawada, Yokosuka (JP); Masanori Kyo, Yokosuka (JP); Takahiro Yokoyama, Yokosuka (JP); Noriaki Sakurai, Yokosuka (JP); Terence Lim, Singapore (SG); Suhaimi Adlina, Singapore (SG); Kim Kok Goi, Singapore (SG); Sim Guan Teo, Singapore (SG)

(73) Assignees: Japan Agency for Marine-Earth Science and Technology, Kanagawa (JP); Nustar Technologies Pte, Ltd, Singapore (SG)

( * ) Notice: Subject to any disclaimer, the term of this patent is extended or adjusted under 35 U.S.C. 154(b) by 45 days.

(21) Appl. No.: 15/932,228

(22) Filed: Feb. 16, 2018

(65) Prior Publication Data

US 2018/0238122 A1 Aug. 23, 2018

(51) Int. Cl.
*E21B 19/00* (2006.01)
*E21B 19/24* (2006.01)
(Continued)

(52) U.S. Cl.
CPC ..... *E21B 19/004* (2013.01); *E21B 15/02* (2013.01); *E21B 17/01* (2013.01); *E21B 19/002* (2013.01); *E21B 19/24* (2013.01)

(58) Field of Classification Search
CPC ..... E21B 19/004; E21B 19/24; E21B 17/01
(Continued)

(56) References Cited

U.S. PATENT DOCUMENTS

2003/0206773 A1 11/2003 Stromberg et al.
2010/0147528 A1 6/2010 Baugh
2016/0356102 A1* 12/2016 Meeks ..... E21B 19/24

FOREIGN PATENT DOCUMENTS

JP 50112703 U 9/1975
JP U04030185 A 3/1992
(Continued)

OTHER PUBLICATIONS

Office Action, App. No. JP2017-027861, dated Oct. 6, 2020, 6 Pages.

(Continued)

*Primary Examiner* — Matthew R Buck
*Assistant Examiner* — Patrick F Lambe
(74) *Attorney, Agent, or Firm* — Berkeley Law & Technology Group, LLP

(57) ABSTRACT

The submarine drilling support system includes a first guide support part that has a ring shape, has a plurality of rollers of which roller axes are directed to a horizontal direction and is arranged along a circumferential direction going around a rotation support axis parallel to a vertical direction, and is provided to allow the drill pipe to be inserted through in the vertical direction; and a first rotation holding part that is configured to support the first guide support part so as to be rotatable in the circumferential direction. The pluralities of rollers are adjacent to each other in the circumferential direction and are arranged in a state where the drill pipe is able to insert through a space surrounded by the plurality of rollers.

13 Claims, 12 Drawing Sheets

(51) Int. Cl.
*E21B 17/01* (2006.01)
*E21B 15/02* (2006.01)

(58) Field of Classification Search
USPC ..... 166/367
See application file for complete search history.

(56) References Cited

FOREIGN PATENT DOCUMENTS

| | | | |
|---|---|---|---|
| JP | 04368592 | A | 12/1992 |
| JP | H10169355 | A | 6/1998 |
| JP | 2004-084199 | A | 3/2004 |
| JP | 2004176530 | A | 6/2004 |
| JP | 2016079613 | A | 5/2016 |
| JP | 2017025553 | A | 2/2017 |
| WO | 2016054610 | A1 | 4/2016 |

OTHER PUBLICATIONS

Notice of Allowance, App. No. JP2017027861, dated Jul. 6, 2021, 6 Pages.

* cited by examiner

SUBMARINE DRILLING SUPPORT SYSTEM

BACKGROUND OF THE INVENTION

Field of the Invention

The present invention is related to a submarine drilling support system.

Priority is claimed on Japanese Patent Application No. 2017-027861, filed Feb. 17, 2017, the content of which is incorporated herein by reference.

Description of Related Art

In the related art, riser drilling which is performed on a ship consist of a riser pipe with large diameter is used and drilling is performed within the riser after the pipe is lowered to the seabed without the influence of the strong tidal current. In such cases, the drill pipes are subjected to bending as a result of fluid resistance resulting from the tidal current, or the repeated fatigue accompanied by the rotation of the drill pipes.

In order to cope with this problem, a type of guide structure called the trumpet-shaped guide horn as shown in the Japanese Unexamined Patent Application, First Publication No. 2004-84199 is adopted. The guide horn extends from the upper portion gripped by a drill pipe to a position approximately 2 meters above sea level. This prevents material degradation and wears resulting from frictional heat caused by the rotation where the drill pipe is in contact with the guide horn and rig. At the same time it prevents damages or slip-out of the drill pipe. However with the use of such guide horns, the constant vertical drifting motion of the casing, tubing and sensor subjects the drill string to fatigue and slip out with the influence of vortex-induced vibration.

The downward drifting of the casing generates vortex caused by vortex-induced vibrations which can be effectively suppressed by attaching a plurality of ropes to the drill pipe. Even so, the drill pipe is always in contact with the guide horn or the slip bowl due to the strong tidal current. Hence becoming a problem if the worn state continues, it can lash out a portion of the rope.

For that reason, the guide horn is replaced with the use of guide rollers, arranged on the moon pool carts so that during downward drifting of the casing string, the bending moment on the drill pipe will be decentralized by the guide rollers and at the same time to efficiently perform attachment of ropes safely below the guide rollers.

SUMMARY OF THE INVENTION

However, in a type in which the guide horn is replaced with guide rollers, the work of attaching and detaching large-sized, heavy, and big guide horn and guide rollers whenever the casing or the like is moved downward occurs. For that reason, a lot of time and effort is needed to handle such a large-sized and heavy loads within a limited space on a ship. With that, there is room for improvements to improve work efficiency.

In view of the problems stated above, the present invention have been proposed to improve work efficiency for riserless drilling In order to achieve the objective, a submarine drilling support system according to a first aspect of the present invention is a submarine drilling support system that is equipped on a ship and is used when a drill pipe is lowered to the seabed and rotated to drill the seabed by riserless drilling. The submarine drilling support system includes a ring-shaped guide support component which houses a plurality of rollers of which the rollers' axes are directed to a horizontal direction. The rollers are arranged along the circumferential direction surrounding the rotation support axis parallel to its vertical axis. The drilling support system is designed such that the drill pipe is capable of being inserted though the main bore of the guide support part so as to be rotatable in the circumferential direction. The plurality of rollers are adjacent to each other in the circumferential direction and are arranged in a state where the drill pipe is able to drift through the space surrounded by the plurality of rollers.

In the present invention, when the drill string is in a bent state due to fluid resistance resulting from the strong tidal currents, comes into contact with a roller of the guide support part, the roller itself rotates around the roller axis.

With this, the drill pipe can smoothly drift downwards in a vertical direction. Moreover, when a lateral force from the drill pipe is exerted on the rollers, the guide support component rotates about its rotational axis in the circumferential direction along with the plurality of rollers. Hence the contact friction between the drill pipe and rollers and be significantly reduced.

Undoubtedly, wear and heat deterioration of the drill pipe and guide rollers can be suppressed. This is especially helpful in conditions whereby the drill pipe is in constant fatigue and twisting due. Hence, the possibility of shortening the construction period.

In the submarine drilling support system according to the second aspect of the present invention, a plurality of support devices including the guide support part and the rotation holding part are arranged at a distance from each other along its vertical direction.

With the proposed invention, the drill pipes are supported by a plurality of fulcrums in the vertical direction through the plurality of support devices provided. By decentralizing the excessive bending moment of the drill pipe from the fluid resistance of the strong tidal current of the rocking of the hull, stress concentration acting on the drill pipe can be reduce thus preventing severe damages and fatigue can be suppressed.

In the submarine drilling support system according to a third aspect of the present invention, a portion of the guide support part in the circumferential direction may be detached.

In the present invention, an opening is provided by removing a portion of the guide support part, allowing easy access for the drill pipe to be inserted through the guide support part. For that reason, it becomes possible to feed the casing through this opening thus allowing work to be performed efficiently.

In the submarine drilling support system according to the fourth aspect of the present invention, the ship provides an opening on the work floor in which the drill pipe may be inserted through, reaching towards the guide support part and the rotation holding part which are arranged below the work floor.

In the present invention, the space above the work floor can be effectively used. Therefore, it is possible to effectively conduct installation of a cable or a sensor for long-term-in-pit measurement in the drill pipe, attachment of a rope for preventing vortex-induced vibration to the drill pipe and so on.

In the present invention, the space above the work floor can be effectively used. Therefore, it is possible to effectively conduct installation of a cable or a sensor for long-term-in-pit measurement in the drill pipe, attachment of a rope for preventing vortex-induced vibration to the drill pipe and so on.

In the present invention, a rotational drive force in the circumferential direction of the guide support part is assisted by a drive device to enable smooth and reliable rotation.

In the submarine drilling support system according to the sixth aspect of the present invention, the rotation assist drive part may be controlled such that the guide support part applies a rotative force to the rotation holding part when a contact of the drill pipe with rollers is detected.

In the present invention, a rotational drive force is applied to the guide support part only when the drill pipe is in contact with the roller. Hence ensuring effective operation can be efficiently performed.

In the submarine drilling support system according to the seventh aspect of the present invention, the guide support is divided into an inner tube and an outer tube. The outer tube holds the inner tube in place however not limiting the inner tube from rotating independently from the former.

The inner and outer tubes can be disassembled separately hence increasing maintenance efficiency.

With the proposed invention, work efficiency of riserless drilling can be vastly improved.

DETAILED DESCRIPTION OF THE INVENTION

Hereinafter, the discussion on the submarine drilling support system is directed to various embodiments of the invention and it shall be described with reference to drawings.

First Embodiment

Figure 1:
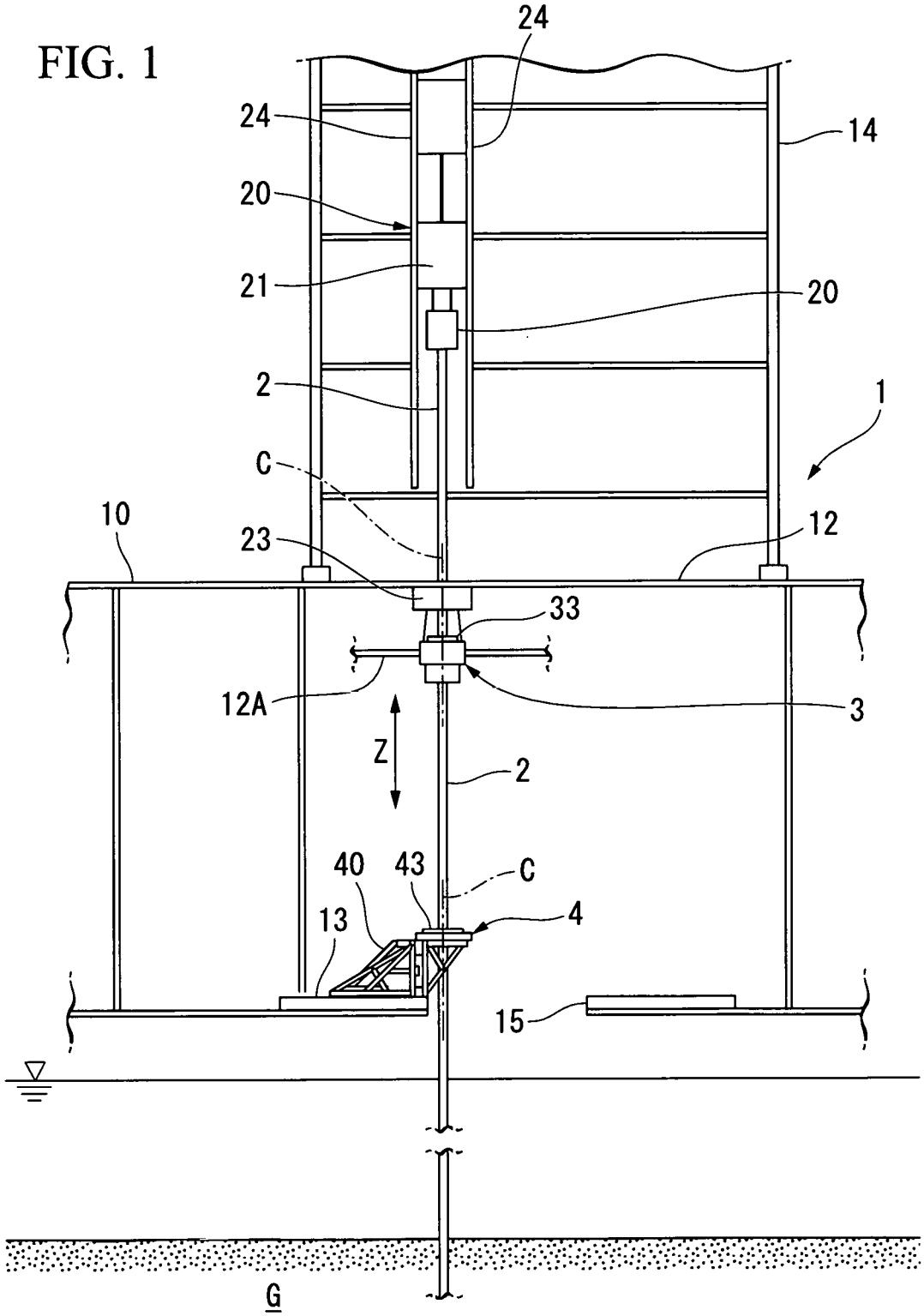
FIG. 1 is a side view showing the components of the main parts of a hull equipped with the submarine drilling support system according to the first embodiment of the present invention.

As shown in FIG. 1, the embodiments of the present disclosure generally related to a submarine support system 1, which is equipped on the hull 10 of the ship to support a plurality of vertical drill pipe 2 in the vent of subsea drilling on the seabed G. In a higher degree, the embodiments relate to reduce wear rate and mitigate the exposure to extreme mechanical stresses on the drill pipes 2 during the drilling process.

In the embodiment, there are upper support device 3 and support device 4. Both support devices are position at different level where the lower support device located below the upper support device, in which able to support the drill pipe at a vertical direction in the hull 10.

The hull 10 includes a drill floor 12 (work floor), also known as work floor, where drilling work is performed at a substantially intermediate part in a forward-rearward direction of the ship. A derrick 14 erected on the drill floor 12 and two moon pool opening platform located below the drill floor 12, where one located at the forward side 13 and other one located on the aft side 15. Both moon pool opening platform are able to move forward-aft direction allowing drilling equipment to pass through the opening into the water from the drill floor 12. In the embodiment, the lower support device 4 can be position on either side of the moon pool platform 13 & 15.

Figure 2:
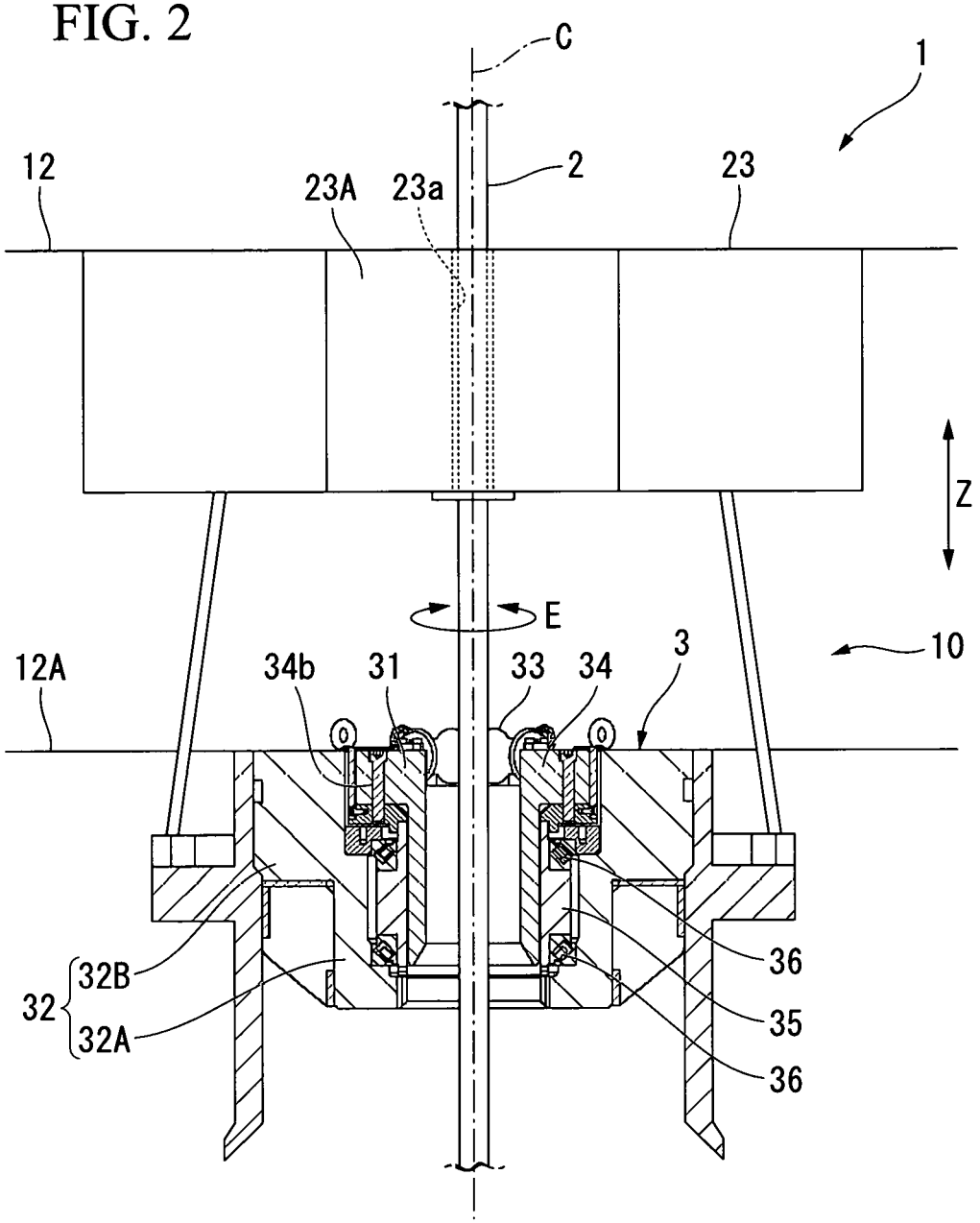
FIG. 2 is a longitudinal sectional view showing the configuration of an upper support device installed on an upper support floor shown in FIG. 1.
Figure 3:
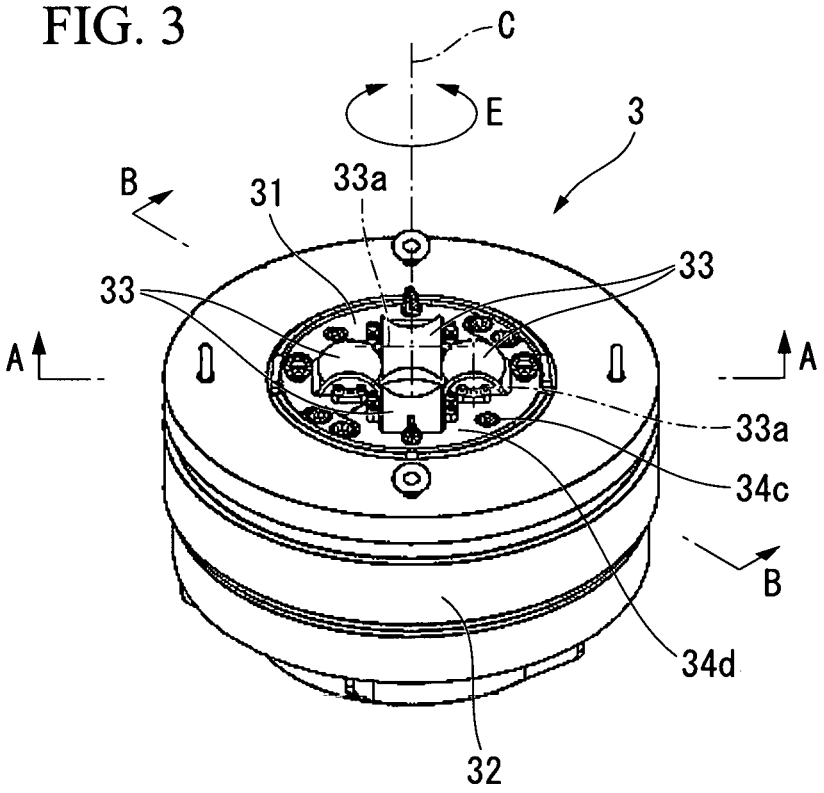
FIG. 3 is a perspective view showing an overall configuration of the upper support device.

In FIG. 2, the upper support floor 12A is located above the moon pool platforms 13 & 15. In the embodiment, the upper support device 3 is installed on the upper support floor 12A.

As shown in FIG. 2, the drill pipe 2 is made up of plurality of hollow steel pipe joint designed with threaded ends at a length of 9 m per joint. In the process of drilling operation, plurality of drill pipe joints will be added and attached to the upper end of the drill pipe 2 in order to drive downward further and drill deeper into the seabed G by rotating the drill pipe about vertical axis Z. In drilling the seabed G, sea water is drawn and pump into of the drill pipe 2. The supplied seawater the inside of the drill pipe 2 will flows through until the lower end part of the drill pipe, the drilling debris generated from the drilling process at the lower end part of the drill pipe where the drill bit is located, the debris and supplied sea water are mixed together and formed into a slurry mixture will be flushed out into the sea.

The seabed drilling device 20 suspended from the derrick 14 comprises of a drill driving unit 21 that is capable to provide rotational force to the drill pipe and simultaneously travel in downward direction to facilitate the process of drilling or upward direction to withdraw the drill pipe from the borehole. Many times, a rotary table 23 located at the drill floor 12 was employed to ensure the drill pipe is gripped on as a safety feature and at the same time the rotary table rotates together with the drill pipe 2.

The guide rail 24 is a mechanism to direct and enable the drill driving unit 21 to travel upward and downward along the derrick. With the support of guide rail 24, it allows the drilling driving unit 21 to create a downward propulsive force onto the drill pipe 2 by moving the drill drive unit 21 downward.

As shown in FIG. 2, the rotary table 23 has a through-hole 23*a* where the drill pipe 2 is inserted through in a vertical direction. The rotary table 23A has built in chuck system at 23*a* where it can provide power grip onto the drill pipe 2 from a radial direction. A rotational force is applied to the drill pipe 2, which is gripped by the chuck part 23A, around the vertical axis Z by the rotary table 23.

Next, the configuration of the upper support device 3 provided on the upper support floor 12A will be described in detail.

As shown in FIG. 2, the upper support device 3 is positioned right below the rotary table 23 in the upper support floor 12A.

As shown in FIGS. 3 to 6, the upper support device 3 includes a ring-shaped first guide support part 31 that has encompass a plurality of rollers 33 (for example, four) of which roller pivot axle 33*a* are directed to a horizontal direction, is designed in a circumferential arrangement about axis E. In which axis E is parallel to axis C in the vertical direction that the drill pipe is capable of being inserted through external housing 32 that supports the first guide support part 31 so as to be rotatable in the circumferential about axis E.

Figure 4:
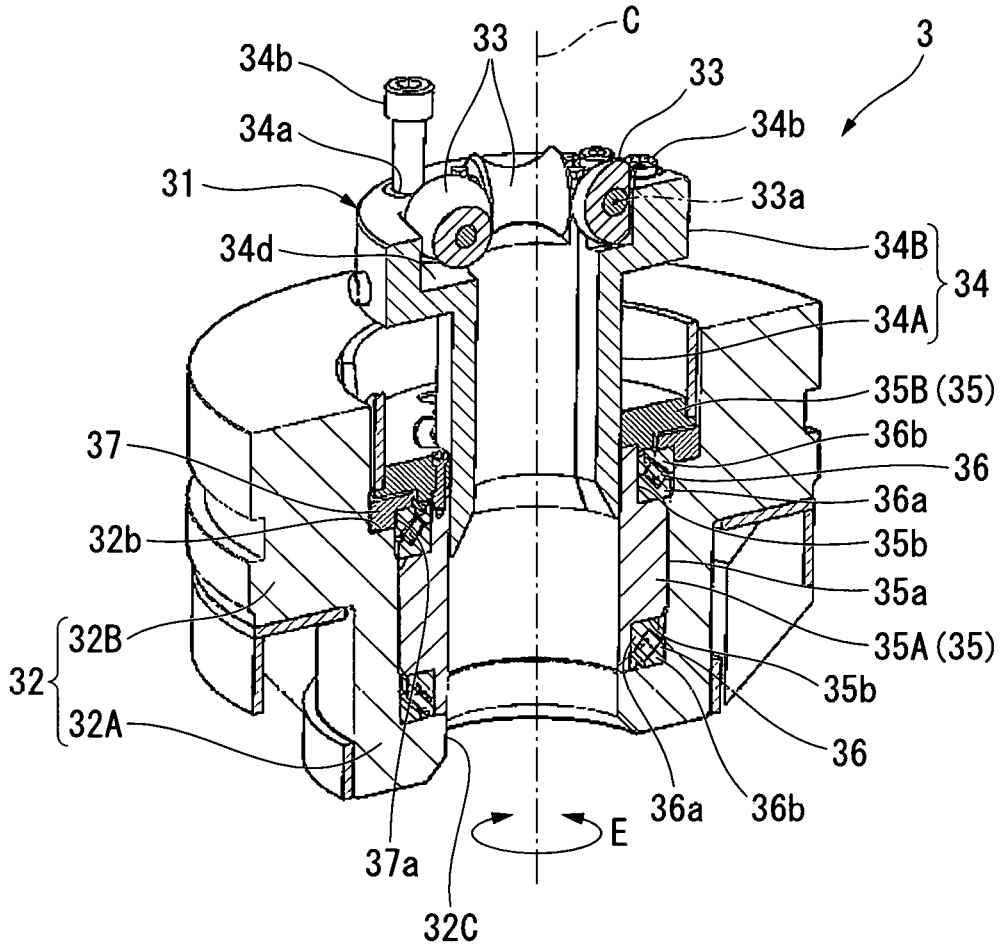
FIG. 4 is a perspective view of a cross section taken along line A-A shown in FIG. 3, and a view showing a configuration whereby the inner assembly is separated from the outer tube.

The first guide support part 31 includes an inner tube 34 and an outer tube 35 that is detachably fitted to the outside of the inner tube 34. Once fitted the inner tube 34 will be locked and unable to rotate in the circumferential direction E as a single body. The inner tube 34 and the outer tube 35 are provided so as to be capable of dividing the inner tube 34 and the outer tube 35 can be divided as shown in FIG. 4. In this way, since the inner tube 34 and the outer tube 35 can be separately taken out by being made dividable, a structure in which maintenance is easy to be carried out.

Figure 6A:
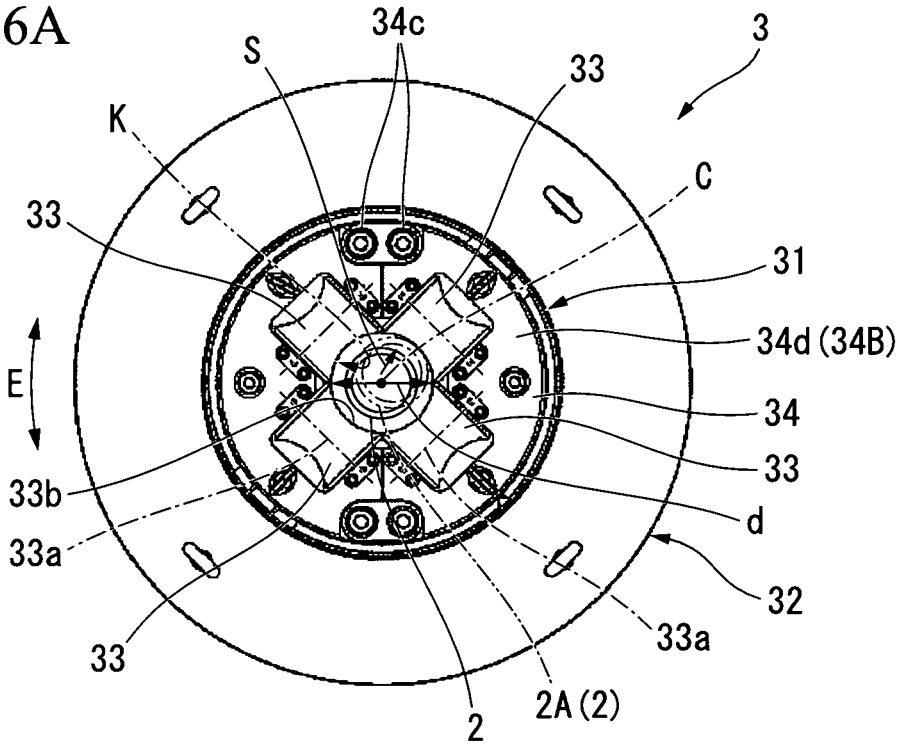
FIG. 6A is a plan view of the upper support device viewed from above showing a state before the first guide support has rotated.
Figure 6B:
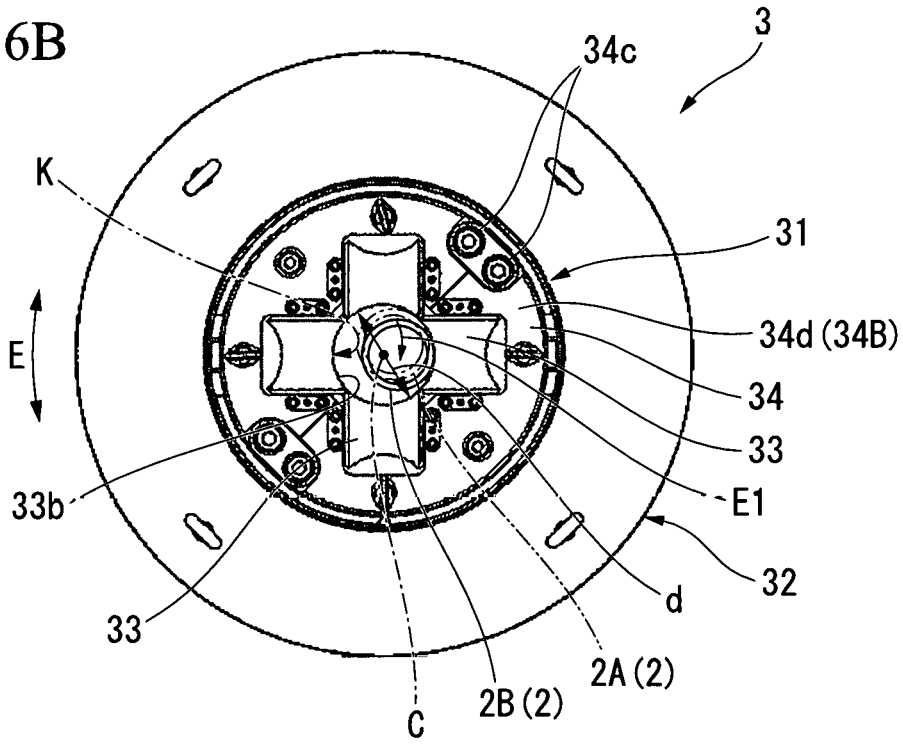
FIG. 6B is a plan view of the upper support device viewed from above showing a state after the first guide support has rotated.

The inner tube 34 includes a smaller-diameter part 34A, and a larger-diameter part 34B that is connected to an upper end of the smaller-diameter part 34A. Larger diameter on 34B is capable of accommodating the rollers 33. The internal diameter of the smaller-diameter part 34A is set to be greater than at least the external diameter of the drill pipe 2. As shown in FIGS. 6A and 6B, the inner tube 34 is longitudinally divided into two by a plane passing through the rotation support axis C. The inner tube 34 can be secured down by installing pins 34*c* through larger-diameter parts 34B to 35B.

On the larger-diameter part 34B has a size of which the diameter is radically bigger than the upper end of the smaller-diameter part 34A over the entire circumference. A plurality of bolt holes 34*a* passing through the larger-diameter part 34B in the vertical direction are radically distributed at intervals about axis E on an outer peripheral side of the larger-diameter part 34B. The inner tube 34 is mounted on the outer tube 35 by the larger-diameter part 34B abutting against an upper end surface of the outer tube 35 from above and bolts 34*b* being inserted through the bolt holes 34*a* and being threaded down and secured into female threaded parts of the outer tube 35.

Additionally, as shown in FIGS. 6A and 6B, the roller housing recessed portion 34*d* in which the four rollers 33 are fixed and accommodated so as to be rotatable about the roller axis 33*a*. The four rollers 33 have formed at an inner peripheral portion on an upper surface side of the larger-diameter part 34B. The four rollers 33 are adjacent to each other in the circumferential direction E and are arranged in a state where the drill pipe 2 is rotating and lowered down into a space surrounded by the rollers 33. Here, the roller axis 33*a* are located in a direction orthogonal to the radial direction centered on the rotation support axis C as viewed from the direction of the rotation support axis C.

Each roller 33 has a shape of a gradually larger diameter toward both ends from a central portion thereof along the roller axis 33*a* thereof. As viewed from the direction of the rotation support axis C, an inner peripheral line 33*b* of each roller 33 on the side of the rotation support axis C is in contact with an imaginary circle K centered on the rotation support axis C, and the inner peripheral lines 33*b* of the four rollers 33 are located substantially all around the imaginary circle K. A diameter dimension d of the imaginary circle K is set to almost the same diameter as the internal diameter of the above-described smaller-diameter part 34A.

Figure 5:
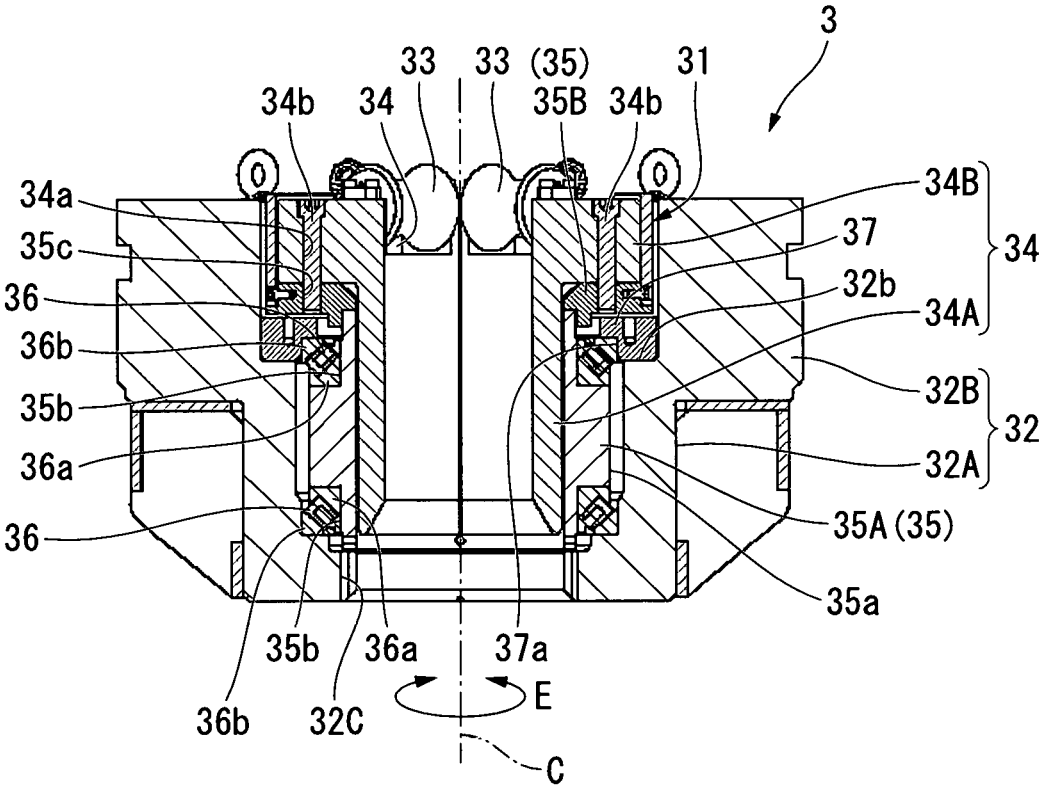
FIG. 5 is front sectional view taken along line B-B shown in FIG. 3.

As shown in FIGS. 4 and 5, the outer tube 35 is comprises a tubular body 35A, a flange part 35B that protrudes over the entire circumference radially outward from an upper end of a tubular body 35A, and a pair of upper and lower bearings 36 and 36 that is arranged on an outer peripheral surface of the tubular body 35A and is interposed between the outer tube 35 and the first rotation holding part 32.

The tubular body 35A internal diameter has the same diameter as the outer diameter of the smaller-diameter part 34A of the inner tube 34, the bearing boxes 35*b* and inner rings 36*a* that extend in the circumferential direction E and are located on radial inner sides of the bearings 36 are fixed are formed on an upper end side and a lower end side of an outer peripheral surface 35*a*. Each bearing 36 is formed as such the inner ring 36*a* and an outer ring 36*b* are movable relatively to each other in the circumferential direction E, and the outer ring 36*b* is fixed to the first rotation holding part 32 side. That is, the tubular body 35A is supported so as to be rotatable in both normal and reverse directions in the circumferential direction E via the bearings 36 with respect to the first rotation holding part 32.

The flange part 35B is coupled to the tubular body 35A in a state where the movement thereof at least in the circumferential direction E is restricted. For that reason, the flange part 35B integrally rotates in the circumferential direction E together with the tubular body 35A. The inner tube 34 is fixed to the flange part 35B by female thread holes 35*c* being formed at positions corresponding to the bolt holes 34*a* of the inner tube 34 and the above-described bolts 34*b* being threaded down and secure into bolt holes 34*a*. Accordingly, the inner tube 34 and the outer tube 35 are configured to be integrally movable in the circumferential direction E.

As shown in FIGS. 4 and 5, the first rotation holding part 32 supports the first guide support part 31 so as to be rotatable around the rotation support axis C. The first rotation holding part 32 includes a holding tube 32A, a larger-diameter tube 32B coaxially provided at an upper part of the holding tube 32A, and a bearing holding ring 37 placed at a bottom part of the larger-diameter tube 32B. Which are all aligned to the circular hole located at the centered of the rotation support axis C.

A bottom flange 32C that protrudes over the entire circumference radially inward is formed at a lower end of the holding tube 32A. The tubular body 35A in the outer tube 35 of the first guide support part 31 is placed on the bottom flange 32C. The outer ring 36*b* of the lower bearing 36 is supported at a corner part between the holding tube 32A and the bottom flange 32C in a state where the rotation thereof in the circumferential direction E is restricted.

The bearing holding ring 37 is tied down to the upper end 32*b* of the holding tube 32A. The flange part 35B of the outer tube 35 is interposed in a state where the movement thereof in the upward-downward direction is restricted. The bearing holding ring 37 is supported at an inner peripheral lower end part 37*a* in a state where the rotation, in the circumferential direction E, of the outer ring 36*b* of the bearing 36 located on the upper side is restricted.

Next, the configuration of the lower support device 4 provided in the lower support floor 13 will be described in details.

Figure 7:
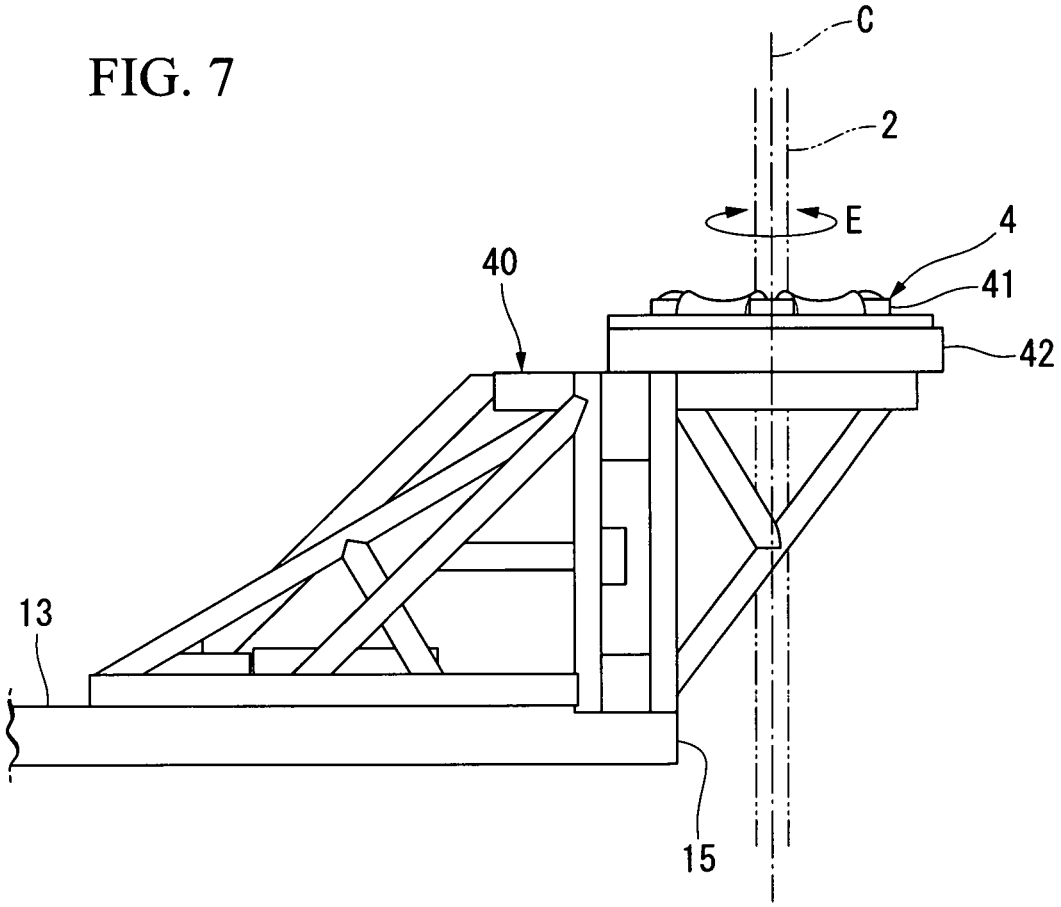
FIG. 7 is a side view of the lower support device installed on the lower support floor.

As shown in FIG. 7, the lower support device 4 is supported by a support mount structure 40 which is placed on the moon pool opening platform 13 located below the upper support device 3 (refer to FIG. 1). The embodiment is arranged in a way such that the rotation support axis C of the lower support device 4 is coincides with a rotational axis of the drill pipe 2.

Figure 8:
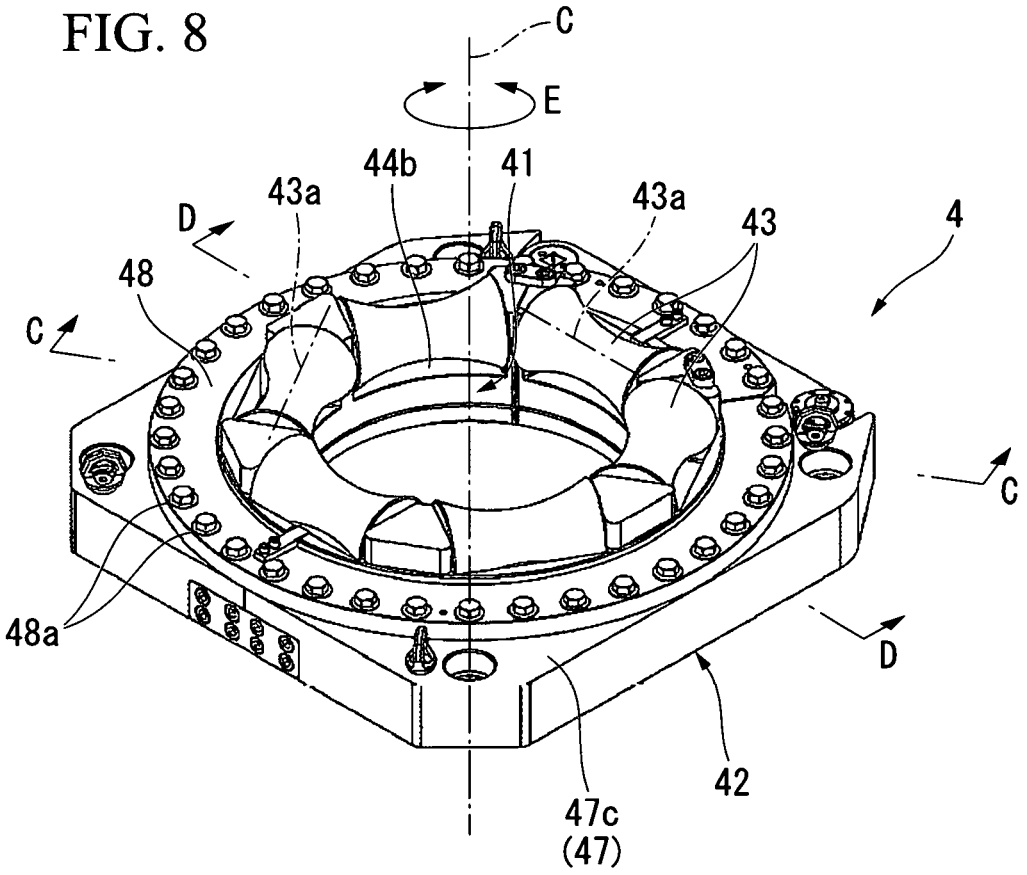
FIG. 8 is a perspective view showing an overall configuration of the lower support device.
Figure 9:
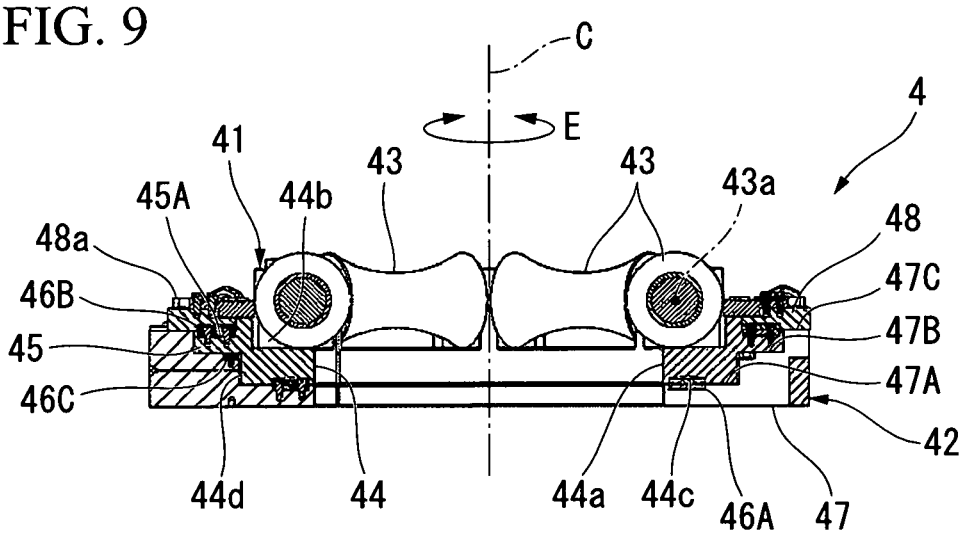
FIG. 9 is a sectional view taken along line C-C shown in FIG. 8.
Figure 10:
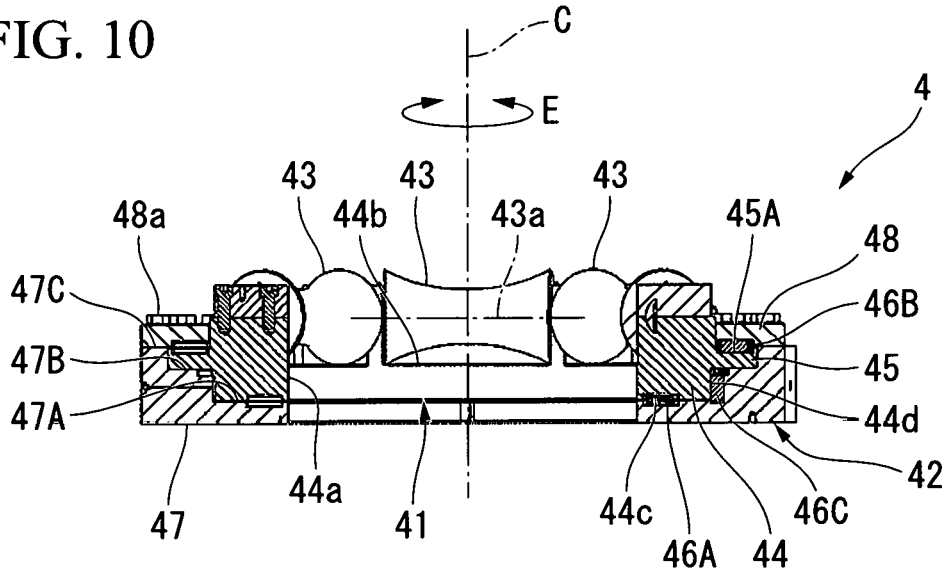
FIG. 10 is a sectional view taken along line D-D shown in FIG. 8.

As shown in FIGS. 8 to 10, the lower support device 4 includes a ring-shaped second guide support part 41 that encompassed a plurality of (for example, six) rollers 43 of which roller axis 43*a* are directed to the horizontal direction. The rollers are arranged in the circumferential direction E about the rotation support axis C parallel to the vertical direction. This enable the drill pipe 2 to be inserted there through in the vertical direction, and a ring-shaped second rotation holding part 42 that supports the second guide support part 41 so as to be rotatable in the circumferential direction E.

The second guide support part 41 includes a ring-shaped support ring body 44 that encompassed the plurality of rollers 43, and an annular rib 45 that protrudes over the entire circumference outward from an intermediate portion, in the upward-downward direction, in an outer peripheral surface of the support ring body 44.

A circular hole 44*a* is formed at an inner peripheral part of the support ring body 44 which has a larger diameter than the circular hole formed in the larger-diameter part 34B of the inner tube 34 of the first guide support part 31 shown in above-described FIG. 5.

Figure 11A:
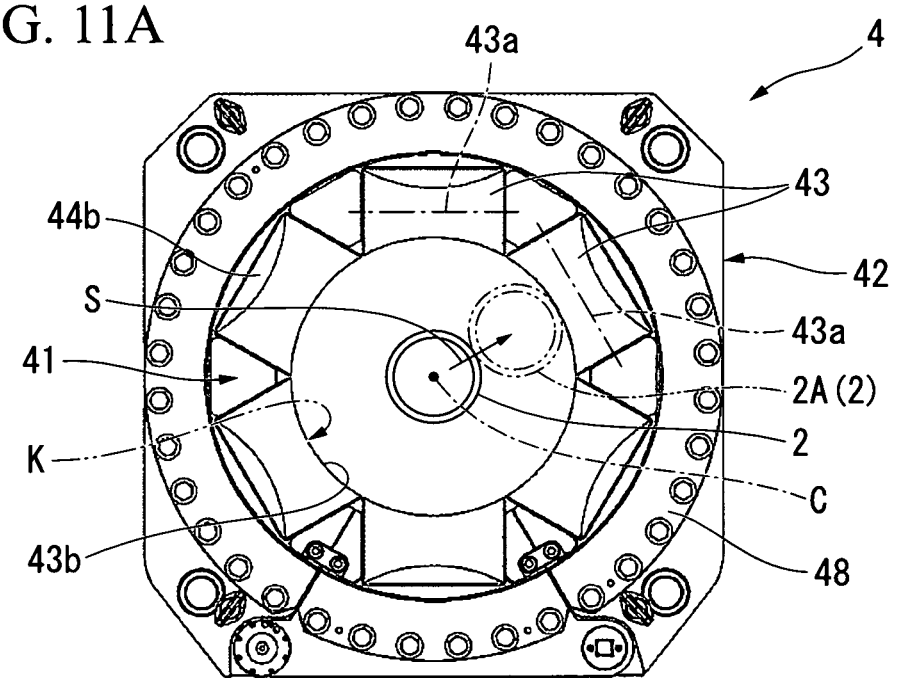
FIG. 11A is a plan view of the lower support device viewed from above and showing a state before the inner support guide assembly rotates.
Figure 11B:
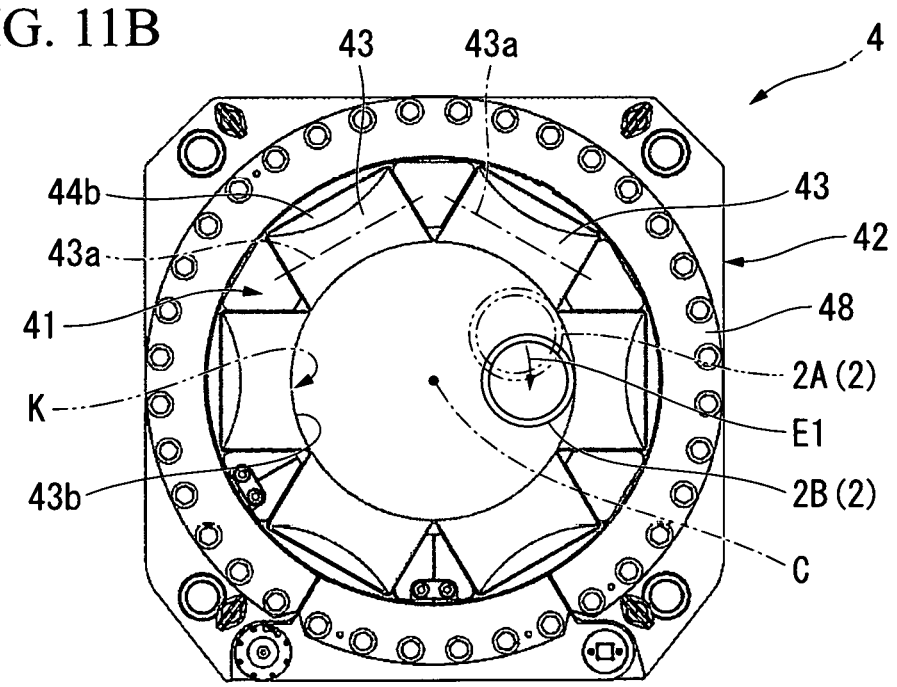
FIG. 11B is a plan view of the lower support device viewed from above and showing a state after the inner support guide assembly rotates.

A roller housing recessed portion 44*b* where the six rollers 43 are fixed and accommodated so as to be rotatable around the roller axis 43*a*. The arrangement of the six rollers were formed on an upper surface side of the support ring body 44. As shown in FIGS. 11A and 11B, the six rollers 43 are arranged in a state where the drill pipe 2 is rotatable and insertable into a space surrounded by the rollers 43. Here, the roller axis 43*a* are located in the direction orthogonal to the radial direction centered on the rotation support axis C as viewed from the direction of the rotation support axis C. Each roller 43 has a shape having a gradually larger diameter toward both ends from a central portion thereof along a roller axis 43*a* thereof. As viewed from the direction of the rotation support axis C, an inner peripheral line 43*b* of each roller 43 on the side of the rotation support axis C is in contact with the imaginary circle K located at the centered of the rotation support axis C, and the inner peripheral lines 43*b* of the six rollers 43 are located substantially all around the imaginary circle K.

Additionally, as shown in FIGS. 9 and 10, a first bearing accommodating part 44*c* that accommodates a lower bearing 46A is provided at a lower end of the support ring body 44.

The lower bearing 46A is formed such that a lower ring and an upper ring are movable relatively to each other in the circumferential direction E, the lower ring is fixed to a second rotation holding part 42 side to be described below, and the upper ring is fixed to the first bearing accommodating part 44*c*.

The portion of the outer peripheral surface of the support ring body 44 below the annular rib 45 (a swirling outer peripheral surface 44*d*) is fitted in a state where the portion is in contact with an inner peripheral part of a side bearing 46C (to be described below) over the entire circumference. The support ring body 44 rotates about axis C and it is guided by the outer peripheral surface 44*d* being in contact with the side bearing 46C.

The annular rib 45 has a bearing accommodating part 45A, which allows the upper bearing 46B to be mounted on an upper surface part of 45A.

The upper bearing 46B is formed such that a lower ring and an upper ring are movable relatively to each other in the circumferential direction E, the upper ring is fixed to the second rotation holding part 42 side with a fixed cover 48 to be described below, and the lower ring is fixed to the bearing accommodating part 45A.

The second rotation holding part 42 supports the second guide support part 41 so as to be rotatable around the rotation support axis C. The ring-shaped second rotation holding part 42 has a holding part body 47 having an inner stepped part 47A that supports the support ring body 44 from below, and an outer stepped part 47B that is adjacent to a radially outer peripheral side with respect to the inner stepped part 47A and supports the annular rib 45 from below, and a ring-shaped fixed cover 48 that covers the annular rib 45 from above and is fixed to an outer peripheral edge part 47C of the second rotation holding part 42.

In the holding part body 47, the outer stepped part 47B is arranged at a position of one step lower than the outer peripheral edge part 47C, whereas the inner stepped part 47A is arranged at a position of one step lower than the outer stepped part 47B.

The lower ring of the lower bearing 46A is fixed to the inner stepped part 47A. Accordingly, the lower bearing 46A is interposed and arranged between the inner stepped part 47A of the holding part body 47 and the support ring body 44 of the second guide support part 41. The side bearing 46C encompassed a plurality of rollers of which rotational axis are directed to the vertical direction, the rollers are arranged in the circumferential direction E is fixed to an inner peripheral edge of the outer stepped part 47B.

The fixed cover 48 is detachably fixed to an upper surface of the outer peripheral edge part 47C of the holding part body 47 by a plurality of bolts 48*a* provided in the circumferential direction. The upper ring of the upper bearing 46B is fixed to a lower surface of the fixed cover 48. Accordingly, the upper bearing 46B is interposed and arranged between the lower surface of the fixed cover 48 and the annular rib 45 of the second guide support part 41.

In the embodiment, the second guide support part 41 is supported so as to be rotatable in both the clockwise and anti-clockwise directions in the circumferential direction E by the support of lower bearing 46A, the upper bearing 46B and the side bearing 46C with respect to the second rotation holding part 42.

Next, in an operation when the seabed G is drilled using the above-described submarine drilling support system 1 with the operation of the submarine drilling support system 1 will be described.

As shown in FIG. 1, when drilling is performed by the seabed drilling device 20. firstly, a plurality of the drill pipes 2 are set in a state where the drill pipes are connected together in the vertical direction while being handled by the seabed drilling device 20. Series of drill pipes 2 are connected together by the threaded portions at both ends of the joint. Next, as shown in FIG. 2, a lower drill pipe 2 can be gripped by the chuck part 23A of the rotary table 23 located on the drill floor 12 allowing the drill pipes 2 to be coupled together by using a pipe tightening device.

Specifically, in the connection work between the drill pipes 2 and 2, after a drill pipe 2 is lowered down through the rotary table 23, the next upper end of the drill pipe 2 will be gripped by the chuck part 23A of the rotary table 23 and to be ready for next drill pipe 2 connection. The next drill pipe 2 will positioned above the drill pipe 2 that was gripped by the chuck part 23A, the rotary table 23 was then rotated and thereby connected to a lower end of the drill pipe 2. By repeating the process for such connection work, for example, three or four drill pipes 2 are connected together and set as described above.

Thereafter, in the seabed drilling device 20, the drill pipes 2 are moved downward by a winch while being sequentially connected together. The drill pipes 2, which was lowered down while being connected together at the same time, passes through an insertion hole of the upper support device 3 located in the upper support floor 12A below the drill floor 12 and also passes through an insertion hole of the lower support device 4 located in the lower support floor 13, to put the drill pipe down to the seabed G.

Then, as shown in FIG. 1, after a tip (lower end) of a drill pipe 2 reaches the seabed G, the seabed G is then drilled by the drill bit when rotational force is applied by the drill drive unit 21 of the seabed drilling device 20. In this case, drilling slurry can be flushed out from borehole by circulating sea water into the through the drill pipes 2.

In this way, if a drill pipe 2 receives the fluid resistance resulting from a strong tidal current (reference signs S in the drawings designate a tidal current direction) as shown in FIGS. 6A and 11A when the drill pipes 2 are moved downward to the seabed G to drill the seabed G, a state where the drill pipe 2 is bent in a lateral direction orthogonal to a vertical axis is brought about. Then, the drill pipe 2A that has laterally moved (here, movement in a direction parallel to the tidal current direction S) due to bending come into contact with the roller 33 of the upper support device 3 and the roller 43 of the lower support device 4 provided at two upper and lower locations of the hull 10. In this case, when the rollers 33 or 43 themselves rotate around the roller axes 33*a* or 43*a*, the drill pipes 2 can be smoothly moved downward in the vertical direction. Additionally, with the rotation of the rollers 33 or 43 themselves, as shown in FIGS. 6B and 11B, a pressing force in the lateral direction against the rollers 33 or 43 can be kept small by rotating the rollers 33 or 43 themselves by an arrow E1 direction around the rotation support axis C.

Specifically, as shown in FIG. 6A, in the upper support device 3, if the drill pipe 2A (shown by a two-dot chain line in FIG. 6A) comes into contact with any one of the four rollers 33, a rotational force in the circumferential direction E is exerted on the inner tube 34 and the outer tube 35 (refer to FIG. 5) via the roller 33 that has received the contact load. For that reason, as shown in FIG. 6B, the first guide support part 31 rotates in the arrow E1 direction around the rotation support axis C with respect to the first rotation holding part 32 via bearings 36A and 36B. In this case, since the first guide support part 31 is rotatable in both the normal and reverse directions, the rotation in the arrow E1 direction is exemplified. However, there is also a case where the first guide support part 31 rotates in a direction opposite to the arrow E1 direction depending on a contact direction of the drill pipe 2A. Then, the drill pipe 2A moves in the circumferential direction E from a two-dot chain line position shown in FIG. 6B to a solid-line position (reference sign 2B) with the rotation of the first guide support part 31.

In addition, as shown in FIG. 11A, in the lower support device 4, if the drill pipe 2A (shown by a two-dot chain line in FIG. 11A) comes into contact with any one of the six rollers 43, a rotational force in the circumferential direction E is exerted on the support ring body 44 and the annular rib 45 (refer to FIG. 10) via the roller 43 that has received the contact load. For that reason, the second guide support part 41 rotates in the arrow E1 direction around the rotation support axis C with respect to the second rotation holding part 42 via the bearings 46A, 46B, and 46C. In this case, since the second guide support part 41 is rotatable in both the normal and reverse directions, the rotation in the arrow E1 direction is exemplified. However, there is also a case where the first guide support part 31 rotates in the direction opposite to the arrow E1 direction depending on the contact direction of the drill pipe 2A. Then, the drill pipe 2A moves in the circumferential direction E from a two-dot chain line position shown in FIG. 11B to a solid-line position (reference sign 2B) with the rotation of the second guide support part 41.

In this way, when the drill pipe 2 is bent in the lateral direction and comes into contact with the rollers 33 or 43, the rollers 33, 43 themselves rotate with the roller axes 33*a* or 43*a* as centers, and when the compressive force in the lateral direction of the drill pipe 2 against the rollers 33 or 43 is exerted, the first guide support part 31 or the second guide support part 41 rotate in the circumferential direction E around the rotation support axis C with the plurality of rollers 33 or 43, the contact friction between the drill pipe 2 and the rollers 33 or 43 can be reduced.

With the above mentioned, wearing effect or heat deterioration impact on the drill pipe 2 and rollers 33 or 43 can be suppressed. It is possible to suppress wear and heat deterioration impact on drill pipe effectively especially under the condition of a strong tidal current, with bending occurs in the drill pipe 2 due to the fluid resistance resulting from the tidal current, or the repeated fatigue accompanying the rotation of the drill pipe 2 occurs. The work efficiency of the riserless drilling is improved with the reduction of wear and heat deterioration impact on drill pipe and this allows shorter construction period.

Particularly, the present embodiment can be applied riserless drilling under a strong tidal current with a tidal current speed of 3.0 knots to 4.5 knots, and can specifically be applied on a super-strong tidal current with a tidal current speed of 4.5 knots or higher.

Additionally, in the present embodiment, the drill pipe 2 is supported by a plurality of (two) fulcrums in the upward-downward direction by the upper support device 3 and the lower support device 4 being provided. With the aforementioned, any decentralizing excessive bending moment of the drill pipe 2 induced by the fluid resistance of the strong tidal current or the rocking of the hull 10 and reducing the stress concentration acting on the drill pipe 2, damage can be prevented, and increment in repeated fatigue can be suppressed.

Additionally, in the submarine drilling support system 1 of the present embodiment, a portion of the guide support part 31 or 41 can be removed to provide an entrance opening for drill pipe 2, and the drill pipe 2 inserted through the guide support part 31 or 41 can be easily accessed. For that reason, it is possible to feed in a casing or equivalent through this opening and perform work efficiently.

Additionally, in the present embodiment, the upper support device 3 including the first guide support part 31 and the first rotation holding part 32 are arranged below the drill floor 12. Thus, a space on the drill floor 12 can be effectively used. For that reason, it is possible to conduct installation of a cable or a sensor for long-term in-pit measurement in the drill pipe 2, attachment of a rope for preventing vortex-induced vibration (VIV) to the drill pipe 2, or equivalent.

As described above, in the submarine drilling support system 1 according to the present embodiment, the work efficiency of the riserless drilling can be improved.

Next, although other embodiments according to the submarine drilling support system of the present invention will be described with reference to the accompanying drawings, the description of the same members and portions as those of the above-described first embodiment will be omitted by using the same reference signs for these members and portions, and components different from those of the first embodiment will be described.

Second Embodiment

Figure 12:
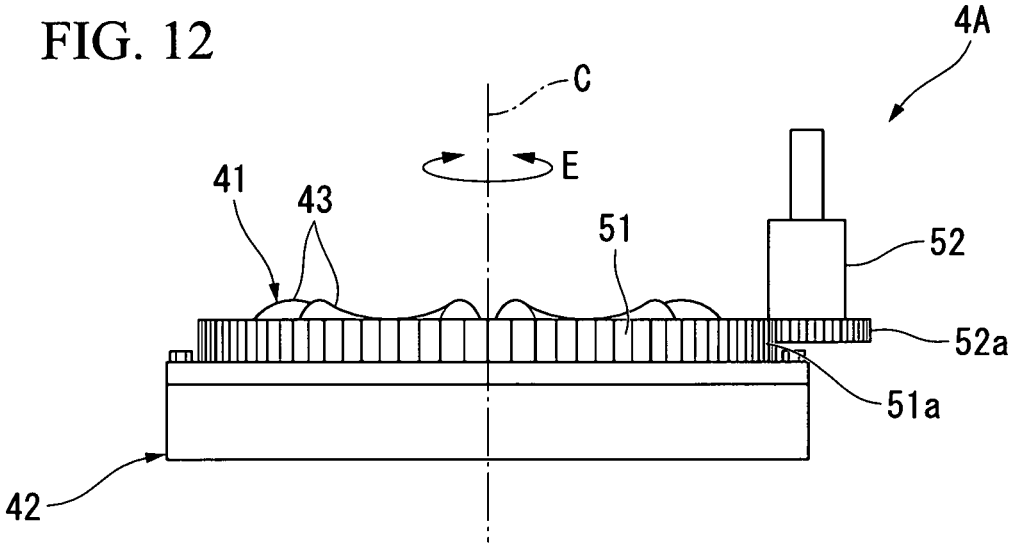
FIG. 12 is a side view showing an overall configuration of the lower support device according to the second embodiment.
Figure 13:
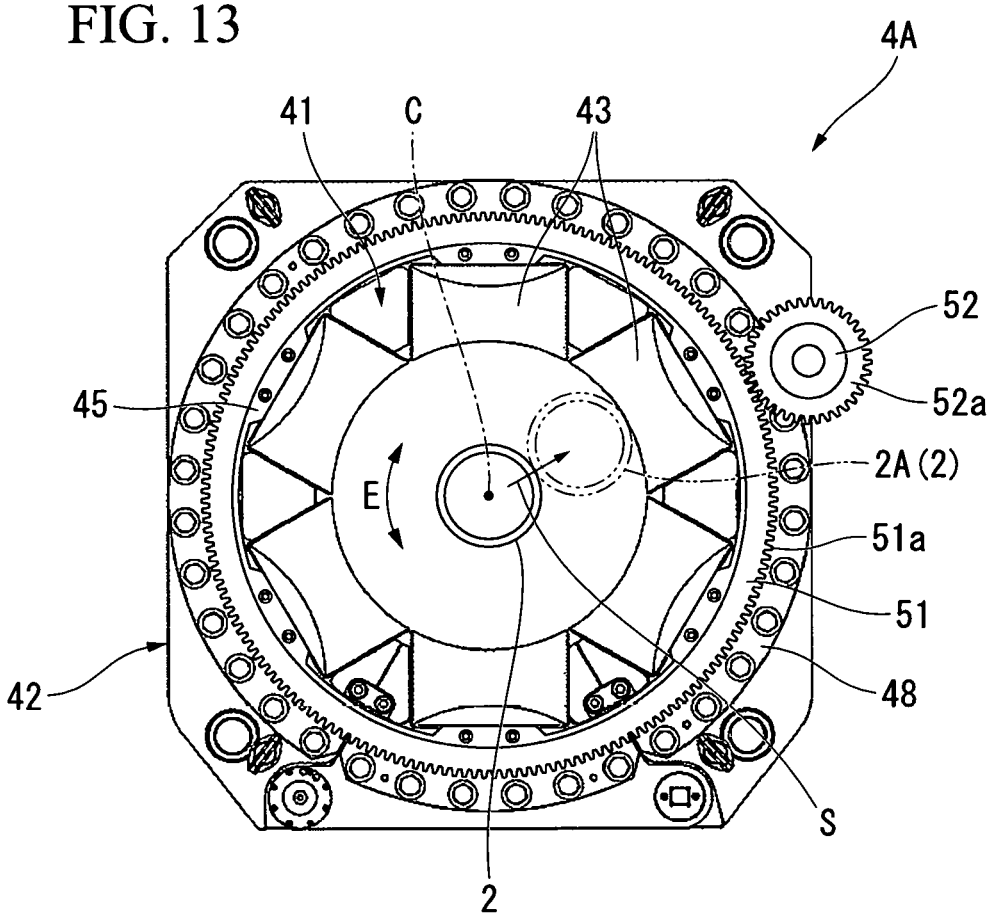
FIG. 13 is a plan view of the lower support device shown in FIG. 12, as viewed from above.

As shown in FIGS. 12 and 13, a submarine drilling support system of a second embodiment has a configuration including a lower support device 4A that auxiliary applies a rotational force in the circumferential direction E to the second guide support part 41.

Specifically, a ring gear 51 (refer FIG. 12), which is provided at an upper end of a support ring body 44 (refer to FIG. 10) of the second guide support part 41 coaxially with the rotation support axis C and is formed with a teeth part 51*a* over the entire circumference, is integrally fixed the lower support device 4A. Moreover, a drive motor 52 (rotation assist drive mechanism), which rotates a teethed gear 52*a* engaged with another teeth part 51*a*, is provided on an outer peripheral side of the ring gear 51. A rotational axis of the gear 52*a* becomes the vertical direction parallel to the above-described rotation support axis C.

In the present embodiment, as shown in FIG. 13, a contact sensor (not shown) or equivalent is provided to detect contact signal when the drill pipe 2A comes into contact with (a state shown by a two-dot chain line of FIG. 13) any of the roller 43 installed on the support ring body 44. The submarine drilling support system is controlled such that the drive motor 52 rotates the ring gear 51 when a contact signal is detected from the contact sensor. The drive motor 52 stops which stop the rotation of the ring gear 51 when drill pipe and roller is detached. The second guide support part 41 rotates with respect to the second rotation holding part 42 (refer FIG. 7), through the rotation of the ring gear 51.

As above, the second embodiment, a rotational drive force in the circumferential direction E of the second guide support part 41 is assisted by the drive motor 52. Thus, smooth and reliable rotation can be realized.

In addition, the present invention is not limited to the control method as described above. For example, it is also possible to make a control so as to drive the drive motor 52 when a load (compressive force) received by each roller 43 becomes larger than a predetermined value. Additionally, the rotational speed, rotational angle, or equivalent of the drive motor 52 may be controlled according to the magnitude of the load (pressing force) received by the roller 43.

In addition, the number of drive motors 52 is not limited to one, and a plurality of drive motors 52 may be arranged for one ring gear 51.

The attachment position of the ring gear 51 may not be limited to the upper end 44*e* of the support ring body 44 unlike the present embodiment, and the ring gear 51 may be provided at other positions.

Although the embodiments of the submarine drilling support system of the present invention have been described above, the present invention is not limited to the above embodiments and can be appropriately changed without departing from the concept of the present invention.

For example, the submarine drilling support system 1 of the present embodiment has a configuration in which the drill pipe 2 put into the sea is supported at two points spaced apart from each other in the vertical direction by the upper support device 3 and the lower support device 4. However, the support points are not limited to such two points. For example, the drill pipe 2 may be supported only by any one of the upper support device 3 and the lower support device 4, and it is also possible to increase the number of support devices to provide a support part of three or more points.

Additionally, in the present embodiment, the upper support device 3 is installed on the upper support floor 12A immediately below the drill floor 12, and the lower support device 4 is installed on the lower support floor 13 having the pool opening 15. However, the installation floors of the support devices 3 and 4 are not limited. Also, in the present embodiment, the lower support device 4 is provided in the support mount 40 assembled onto the lower support floor 13. However, the support mount 40 may be omitted, or other support structures may be adopted.

Additionally, the configurations, such as the shapes and sizes of the respective parts of the upper support device 3 and the lower support device 4, the number of the rollers 33 or 43, and the positions and number of the bearings 36 or 46 can be appropriately set corresponding to conditions, such as the diameter of the drill pipe 2 or the load received due to the strong tidal current.

Additionally, in the second embodiment, there is provided a mechanism in which the drive motor 52 is provided only in the lower support device 4A to assist in the rotational drive force of the second guide support part 41 via the ring gear 51. However, the present invention is not limited to only the lower support device 4A, and the same drive motor 52, the same ring gear 51, and the like may also be provided for the upper support device 3.

While the preferred embodiment of the present invention has been described and shown above, it should be understood that the present invention is not limited to the embodiment only. Additions, omissions, substitutions, and other modifications of the configuration can be made without departing from the concept of the present invention. The present invention is not to be considered as being limited by the foregoing description and is limited only by the scope of the appended claims.

What is claimed is:

1. A device of a submarine drilling support system that is equipped on a ship and is used when a drill pipe is made to reach the seabed and the drill pipe is rotated to drill the seabed by riserless drilling, the device comprising:

a guide support part that has a ring shape, has a plurality of rollers which rotate around roller axes extending in parallel to a horizontal plane and which are arranged along a circumferential direction around a rotation support axis parallel to a vertical direction, and supports the drill pipe during rotational drilling by riserless drilling being inserted through the guide support part along the vertical direction; and a rotation holding part that is configured to support the guide support part through which the drill pipe during rotational drilling by riserless drilling is inserted such that the guide support part is rotatable at least 360° around the rotation support axis, wherein the plurality of rollers are adjacent to each other in the circumferential direction and are arranged in a state where the drill pipe configured to be rotatable is able to insert through a space surrounded by the plurality of rollers, and a diameter of a hole surrounded by the plurality of rollers arranged in the circumferential direction is greater than an outer diameter of the drill pipe.

2. The device of a submarine drilling support system according to claim 1, wherein a portion of the guide support part in the circumferential direction is detachably provided.

3. The device of a submarine drilling support system according to claim 1 further comprising:

a rotation assisted drive mechanism that is configured to auxiliary apply a rotational force around the rotation support axis to the guide support part.

4. The device of a submarine drilling support system according to claim 3, wherein the rotation assisted drive mechanism is controlled to apply a rotational force to the guide support part such that the guide support part rotates with respect to the rotation holding part when a contact of the drill pipe with the rollers is detected.

5. The device of a submarine drilling support system according to claim 1, wherein the guide support part is provided to be divided into an inner tube, and an outer tube that holds the inner tube so as to be attachable to and detachable from the inner tube and so as not to be capable of rotating the inner tube around the rotation support axis, and wherein the plurality of rollers are arranged in the inner tube, and the outer tube is rotatable and hold by the rotation holding part.

6. The device of a submarine drilling support system according to claim 1, wherein the rotation holding part supports the guide support part such that the guide support part rotates around the rotation support axis due to a contact load when the drill pipe comes into contact with the guide support part.

7. The device of a submarine drilling support system according to claim 1 further comprising:

a rotation drive mechanism that is configured to apply a rotational force around the rotation support axis to the guide support part.

8. The device of a submarine drilling support system according to claim 1, wherein the hole surrounded by the plurality of rollers has the same shape as an imaginary circle centered on the rotation support axis, the plurality of rollers include a plurality of inner peripheral lines which have a same curvature radius as a radius of the imaginary circle when viewed in a direction of the rotation support axis, and the plurality of inner peripheral lines are located on a circumference of the imaginary circle.

9. A submarine drilling support system that is equipped on a ship and is used when a drill pipe is made to reach the seabed and the drill pipe is rotated to drill the seabed by riserless drilling, wherein at least two support devices including the guide support part and the rotation holding part according to claim 1 are arranged at a distance from each other in the vertical direction.

10. A submarine drilling support system that is equipped on a ship and is used when a drill pipe is made to reach the seabed and the drill pipe is rotated to drill the seabed by riserless drilling, wherein a work floor on the ship including an opening through which the drill pipe is inserted into, and wherein a support device including the guide support part and the rotation holding part according to claim 1 is arranged below the work floor.

11. A submarine drilling support system that is equipped on a ship and is used when a drill pipe is made to reach the seabed and the drill pipe is rotated to drill the seabed by riserless drilling, the system comprising:

a upper support device; and a lower support device that is located below the upper support device in the vertical direction and is arranged at a distance from the upper support device, wherein the upper support device includes a first guide support part that has a ring shape, has a plurality of first rollers which rotate around roller axes extending in parallel to a horizontal plane, and which are arranged along a circumferential direction around a rotation support axis parallel to a vertical direction, and supports the drill pipe during rotational drilling by riserless drilling being inserted through the first guide support part along the vertical direction; and a first rotation holding part that is configured to support the first guide support part through which the drill pipe during rotational drilling by riserless drilling is inserted such that the first guide support part is rotatable at least 360° around the rotation support axis, wherein the plurality of the first rollers are is adjacent to each other in the circumferential direction and arranged in a state where the drill pipe configured to be rotatable is able to insert through a first insert space surrounded by the plurality of the first rollers, and a diameter of a first hole surrounded by the plurality of first rollers arranged in the circumferential direction is greater than an outer diameter of the drill pipe, wherein the lower support device includes a second guide support part that has a ring shape, has a plurality of second rollers of which rotate around roller axes extending in parallel to a horizontal plane, and which are arranged along a circumferential direction around a rotation support axis parallel to a vertical direction, and supports the drill pipe during rotational drilling being inserted through the guide support part along the vertical direction; and a second rotation holding part that is configured to support the second guide support part through which the drill pipe during rotational drilling is inserted such that the second guide support part is rotatable at least 360° around the rotation support axis, wherein the plurality of the second rollers are adjacent to each other in the circumferential direction and arranged in a state where the drill pipe configured to be rotatable is able to insert through a second insert space surrounded by the plurality of the second rollers, a diameter of a second hole surrounded by the plurality of second rollers arranged in the circumferential direction is greater than the outer diameter of the drill pipe, and the second insert space of the lower support device is greater than the first insert space of the upper support device.

12. The submarine drilling support system according to claim 11, wherein the first guide support part rotates around the rotation support axis due to a contact load when the drill pipe comes into contact with the first guide support part, and the submarine drilling support system further comprises a rotation drive mechanism that is configured to apply a rotational force around the rotation support axis to the second guide support part.

13. The submarine drilling support system according to claim 11 further comprising:

a first rotation drive mechanism that is configured to apply a rotational force around the rotation support axis to the first guide support part, and a second rotation drive mechanism that is configured to apply a rotational force around the rotation support axis to the second guide support part.

* * * * *